US012195292B2

(12) United States Patent
Nishizawa et al.

(10) Patent No.: US 12,195,292 B2
(45) Date of Patent: Jan. 14, 2025

(54) SHEET FEEDING APPARATUS

(71) Applicants: Seiji Nishizawa, Yamanashi (JP); Kazunori Hatakawa, Yamanashi (JP)

(72) Inventors: Seiji Nishizawa, Yamanashi (JP); Kazunori Hatakawa, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 94 days.

(21) Appl. No.: 18/138,342

(22) Filed: Apr. 24, 2023

(65) Prior Publication Data

US 2024/0034585 A1 Feb. 1, 2024

(30) Foreign Application Priority Data

Apr. 25, 2022 (JP) ..... 2022-071645

(51) Int. Cl.

| | |
|---|---|
| ***B65H 3/48*** | (2006.01) |
| ***B65H 1/14*** | (2006.01) |
| ***B65H 3/06*** | (2006.01) |
| ***B65H 7/02*** | (2006.01) |
| ***B65H 7/16*** | (2006.01) |

(52) U.S. Cl.

CPC ..... *B65H 3/48* (2013.01); *B65H 1/14* (2013.01); *B65H 3/06* (2013.01); *B65H 3/0684* (2013.01); *B65H 7/02* (2013.01); *B65H 7/16* (2013.01); *B65H 2301/4231* (2013.01); *B65H 2405/15* (2013.01); *B65H 2511/414* (2013.01); *B65H 2511/416* (2013.01); *B65H 2515/10* (2013.01); *B65H 2515/20* (2013.01); *B65H 2801/06* (2013.01)

(58) Field of Classification Search

CPC ..... B65H 3/48; B65H 3/0684; B65H 7/16; B65H 3/06; B65H 7/02; B65H 2301/4231; B65H 2801/06; B65H 3/08; B65H 3/14

USPC ..... 271/117, 97, 105

See application file for complete search history.

(56) References Cited

U.S. PATENT DOCUMENTS 10,571,848 B2 * 2/2020 Tanaka ..... G03G 15/6511
2005/0285326 A1 12/2005 Uji et al.

FOREIGN PATENT DOCUMENTS

| | | |
|---|---|---|
| JP | 2006-008380 A | 1/2006 |
| JP | 2019-163120 A | 9/2019 |
| JP | 2021-187596 A | 12/2021 |

* cited by examiner

*Primary Examiner* — Jeremy R Severson

(74) *Attorney, Agent, or Firm* — HAUPTMAN HAM, LLP

(57) ABSTRACT

A sheet feeding apparatus for feeding sheets is provided with a delivery roller for delivering sheets on a stack tray, and an air blower mechanism for blowing air to the sheets on the stack tray, and selects to execute one of first operation for blowing air to the sheets to handle the sheets on the stack tray in a state in which the delivery roller is brought into contact with the sheets stacked on the stack tray, and second operation for blowing air to the sheets on the stack tray to handle the sheets in a state in which the delivery roller is retracted from the sheets stacked on the stack tray.

14 Claims, 8 Drawing Sheets

SHEET FEEDING APPARATUS

BACKGROUND OF THE INVENTION

1. Field of the Invention

The present invention relates to a sheet feeding apparatus provided with sheet handling modes capable of being selected corresponding to attribution such as paper quality and basis weight of sheets.

2. Description of Related Arts

Conventionally, an image forming apparatus such as a printer and a copier has been provided with a sheet feeding apparatus which includes a stack tray capable of stacking many sheets and which is capable of feeding sheets continuously from the stack tray. Such a sheet feeding apparatus is provided with a delivery roller for coming into contact with a top face of an uppermost sheet of a plurality of sheets stacked on the stack tray to deliver, a separation roller for separating sheets picked-up from the delivery roller on a sheet-by-sheet basis to feed, and a conveyance roller for conveying the sheet from the separation roller to the image forming apparatus.

In the above-mentioned sheet feeding apparatus, there is a known sheet feeding apparatus provided with a function of blowing air to sheets stacked on the stack tray, and thereby handling the sheets on the stack tray to facilitate separation of the sheets. In Japanese Unexamined Patent Publication No. 2019-163120 is disclosed a sheet feeding apparatus provided with a sheet handling function by air of retracting the delivery roller from the sheets in handling the sheets by air, and immediately before starting sheet feeding, bringing the delivery roller into contact with the sheet.

In such a sheet feeding apparatus for performing sheet handling by air, in blowing air, there is the case that sheet feeding failure occurs because the sheet floats or misregistration occurs corresponding to attribution of the sheet.

SUMMARY OF THE INVENTION

The present invention provides a sheet feeding apparatus which is provided with a delivery roller for delivering sheets on a stack tray, and which selects to execute one of first operation for blowing air to the sheets to handle the sheets on the stack tray in a state in which the delivery roller is brought into contact with the sheets stacked on the stack tray, and second operation for blowing air to the sheets on the stack tray to handle the sheets in a state in which the delivery roller is retracted from the sheets stacked on the stack tray.

DETAILED DESCRIPTION OF THE PREFERRED EMBODIMENT

Figure 1:
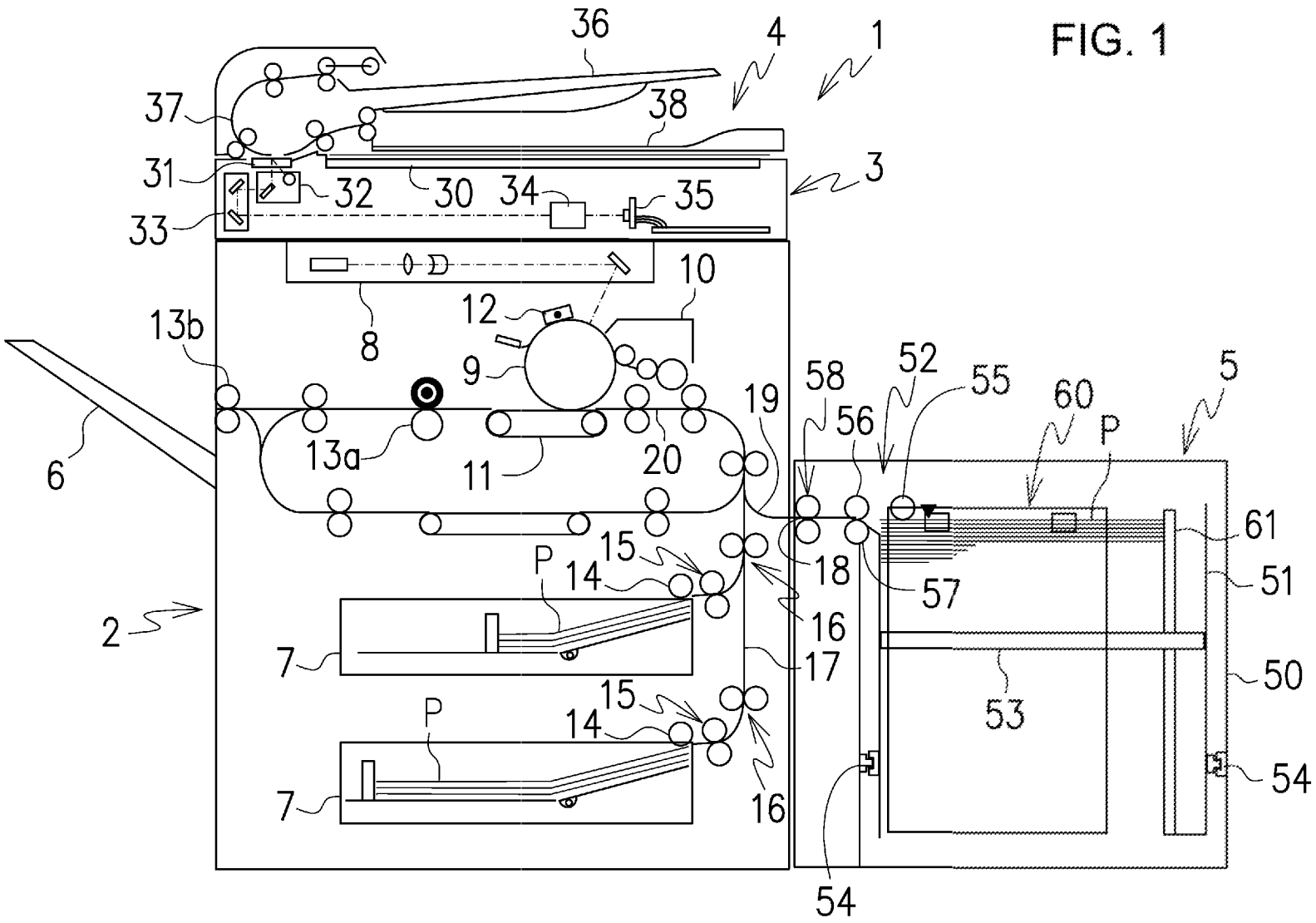
FIG. 1 is an entire configuration view of an image forming system provided with a sheet feeding apparatus according to one Embodiment of the present invention.

This Embodiment of the present invention will be described below in detail, with reference to accompanying drawings. Referring to FIG. 1, described first is a general outline of an image forming system 1 including a sheet feeding apparatus 5 of the present invention. The image forming system 1 is comprised of an image forming apparatus 2 having an original document reading section 3 and original document feeding section 4, and the sheet feeding apparatus 5 connected to the image forming apparatus 2. Based on image data read from an original document image by the original document reading section 3, the image forming apparatus 2 forms an image on a sheet supplied from one of a sheet feeding cassette 7 and the sheet feeding apparatus 5, and collects the sheet with the image formed in a collection section 6. It is also possible to feed an original document sheet to the original document sheet reading section 3 by the original document feeding section 4.

Herein, it is assumed that sheets handled in the image forming system 1 include OHP sheets, tracing paper, coat paper, etc. in addition to plain paper. Further, sizes of sheets are not particularly limited, and may correspond to a plurality of types of sizes.

The image forming apparatus 2 is provided with a charging device 12, projector device (laser head) 8, photosensitive drum 9, developing device 10, transfer charger 11, and fuser roller 13*a*. An electrostatic latent image (static image) is formed, by the projector device 8, on a surface of the photosensitive drum 9 charged by the charging device 12, and the developing device 10 adds toner to the electrostatic latent image. Then, the toner added onto the photosensitive drum 9 is transferred to the sheet supplied from the sheet feeding cassette 7 or the sheet feeding apparatus 5 by the transfer charger 11. The sheet with the toner transferred is sent to the fuser roller 13*a* disposed on the downstream side, and after heating and fusing the toner on the sheet, is discharged to the collection section 6 by a sheet discharge roller pair 13*b*.

The sheet feeding cassette 7 is provided with a delivery roller 14 for coming into contact with an uppermost face of the stored sheets to deliver the sheet, and a separation roller pair 15 for separating delivered sheets on a sheet-by-sheet basis to feed. The sheets are delivered from the sheet feeding cassette 7 by the delivery roller 14, and are separated on a sheet-by-sheet basis by the separation roller pair 15. The separated sheet is conveyed through a cassette conveyance path 17 extending along a side portion facing the sheet feeding apparatus 5, by a conveyance roller pair 16 comprised of a drive roller and a driven roller. Then, the sheet merges with a carry-in path 19 communicating with a carry-out opening 18 of the sheet feeding apparatus 5, and then, is sent to the transfer charger 11 along a conveyance path 20.

On a top portion of the original document reading section 3, first platen 30 and second platen 31 each formed of transparent glass are parallel arranged in a horizontal direction. The first platen 30 is used in reading an original document manually set, and is formed in a size for allowing a support-capable maximum size of original document to be placed. Further, the second platen 31 is used in reading an original document which is fed from the original document feeding apparatus 4 and shifts at a predetermined velocity.

Inside the original document reading section 3 is provided a first reading carriage 32, a second reading carriage 33, and a photoelectric conversion mechanism having a condenser lens 34 and photoelectric conversion element 35. The first reading carriage 32 and second reading carriage 33 are driven by carriage motors (not shown), and shift to reciprocate in a sub-scanning direction below the first platen 30. The first reading carriage 32 is provided with a lamp for applying light to the original document, and a mirror for reflecting light reflected from the original document. Further, the second reading carriage 33 is provided with two mirrors for guiding the light from the mirror of the first reading carriage 32 to the condenser lens 34 and photoelectric conversion element 35. In reading the original document on the first platen 30, while shifting the first reading carriage 32 and second reading carriage 33, the first reading carriage 32 applies light to an image of the original document placed on the first platen 30. Then, the reflected light from the original document is guided to the photoelectric conversion element 35 via the first reading carriage 32 and second reading carriage 33. The photoelectric conversion element 35 converts the received light into an electric signal, and thereby generates image data from the original document. Thus generated image data is transmitted to the projector device 8 of the image forming apparatus 2 as an image signal.

The original document feeding section 4 is provided with a fixed stack tray 36, sheet conveyance mechanism 37 and discharge tray 38, conveys original documents placed on the stack tray 36 on a sheet-by-sheet basis by the sheet conveyance mechanism 37, and passes the sheet onto the second platen 31 to discharge to the discharge tray 38.

Figure 2:
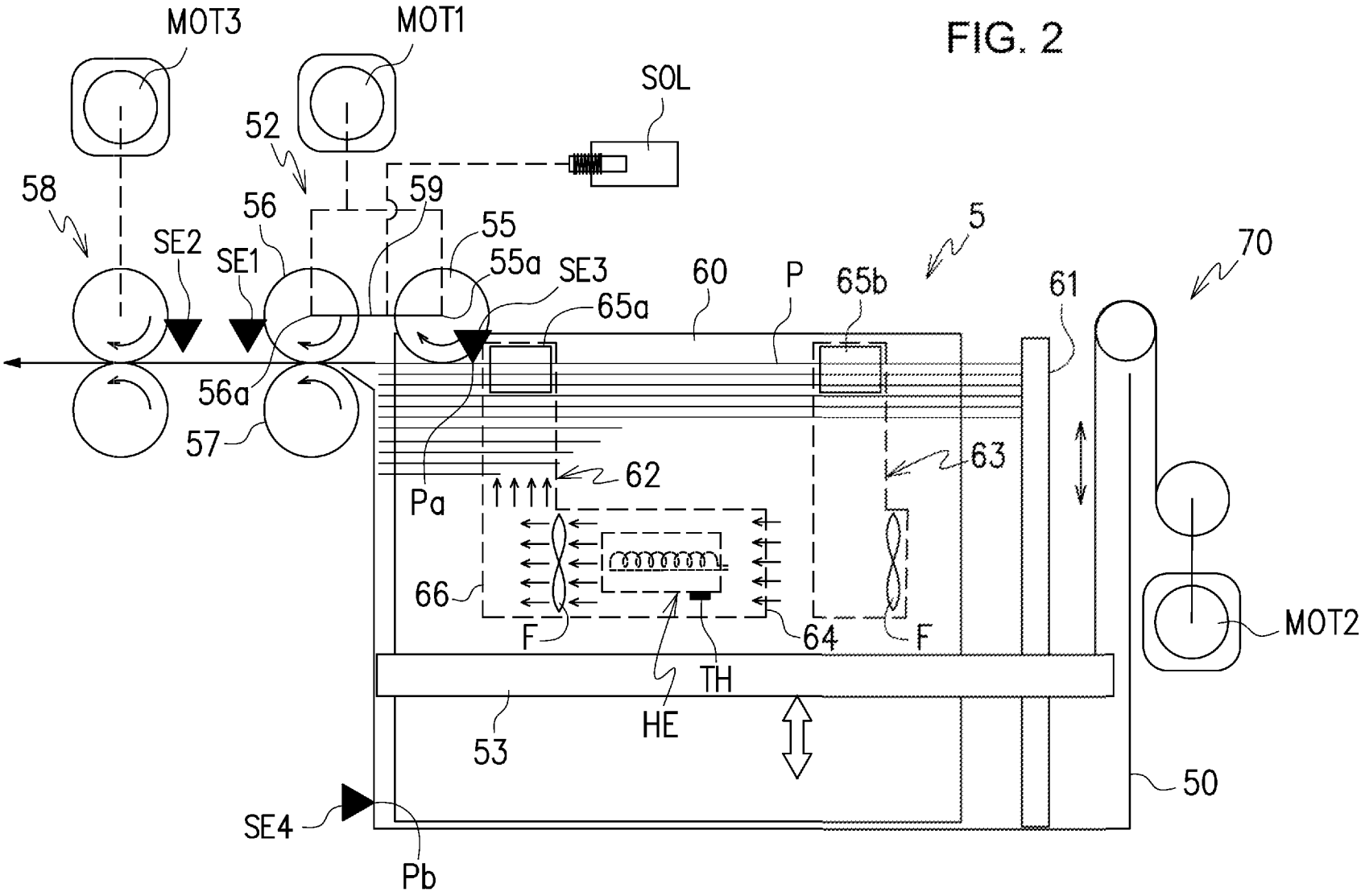
FIG. 2 is a schematic cross-sectional view illustrating an internal configuration of the sheet feeding apparatus.
Figure 3A:
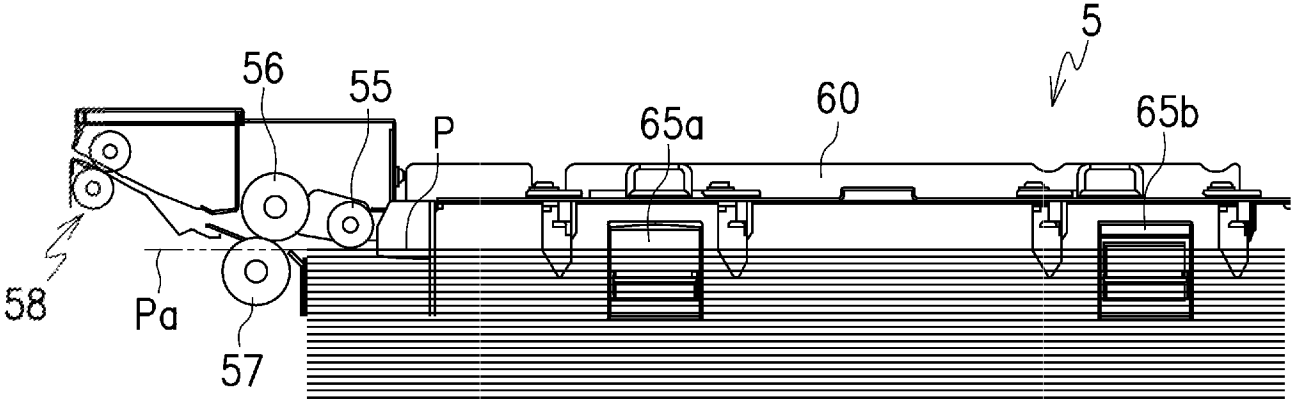
FIGS. 3A and 3B are cross-sectional views illustrating a separation sheet feeding mechanism of the sheet feeding apparatus.
Figure 3B:
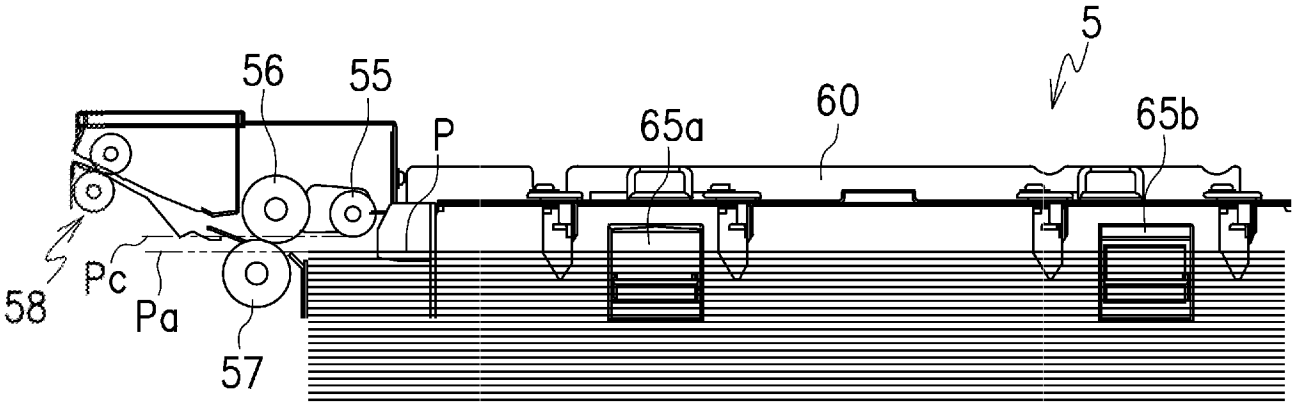

FIGS. 2, 3A and 3B illustrate an internal structure of the sheet feeding apparatus 5. As shown in FIG. 1, a storage chamber 51 is supported by a housing 50 to enable the chamber 51 to be pulled out via a slide rail 54. A separation sheet feeding mechanism 52 is provided with a delivery roller 55, sheet feeding roller 56 each driven by a sheet feeding motor MOT1, and separation roller 57, first picks up an uppermost sheet stacked on a movable stack tray 53 using the delivery roller and feeds the picked-up sheet to the image forming apparatus 2, in a state in which the sheet is separated on a sheet-by-sheet basis by rotation of the sheet feeding roller 56 and separation roller 57.

Inside the storage chamber 51 is provided the stack tray 53 capable of moving up and down. The stack tray 53 is formed by a plane-shaped plate, and is capable of stacking a plurality of sheets P in a state of a bundle on the plate. Further, on a top portion of the storage chamber 51 is provided a top-face sensor SE3 for detecting a position of an uppermost face of the sheets P stacked on the stack tray 53. The stack tray 53 is driven to move up and down to a position such that the top-face sensor SE3 contacts the sheet, by an up-and-down motor MOT2 provided in an up-and-down mechanism 70.

Inside the sheet feeding apparatus 5 are provided side regulation plates 60 for regulating a position of the sheet in a depth direction. These plates are configured to be able to shift in a sheet width direction inside the sheet feeding apparatus 5 according to a size in the depth direction of the sheet. Further, a rear end regulation plate 61 is provided to regulate a position of the sheet in a length direction (sheet conveyance direction). The plate is configured to be able to shift in the sheet length direction inside the sheet feeding apparatus 5 according to a size in the sheet length direction of the sheet.

The side regulation plate 60 is provided with an air blower mechanism (air blower unit) 80 comprised of a first air blower section 62 disposed on the downstream side in the sheet conveyance direction, and a second air blower section 63 disposed on the upstream side in the sheet conveyance direction. The first air blower section 62 is provided with an air blower path (duct) 66 having a suction opening 64 and a blowoff opening 65*a*, and an air blower fan F and heater HE disposed inside the duct 66, and the blowoff opening 65*a* is directed to the downstream side in the conveyance direction of the uppermost sheet P stacked on the stack tray 53. The second air blower section 63 is configured in the same manner as the first air blower section 62 except that the heater HE is not provided, and a blowoff opening 65*b* is disposed on the upstream side in the conveyance direction of the sheet P. The air blower fan F is controlled to rotate independently. In this Embodiment, in order to perform separation feeding of sheets by the separation sheet feeding mechanism 52 more reliably, the heater HE is provided in the first air blower section 62 having the blowoff opening 65*a* opened in the vicinity of the delivery roller 55. Thus, it is enough that at least one air blower section provided with the heater HE exists on the side closer to the separation sheet feeding mechanism 52, and when the air blower section provided with at least the air blower fan F further exists on the upstream side in the sheet conveyance direction, sheet handling is made ease for long sheets of A3 or more.

Further, it is possible to provide the blowoff openings 65*a*, 65*b* with louvers (not shown) for enabling a direction of the air to be varied. By providing such louvers, since the air blown to the sheet varies vertically, it is possible to further enhance the handling effect of sheets.

Figure 4:
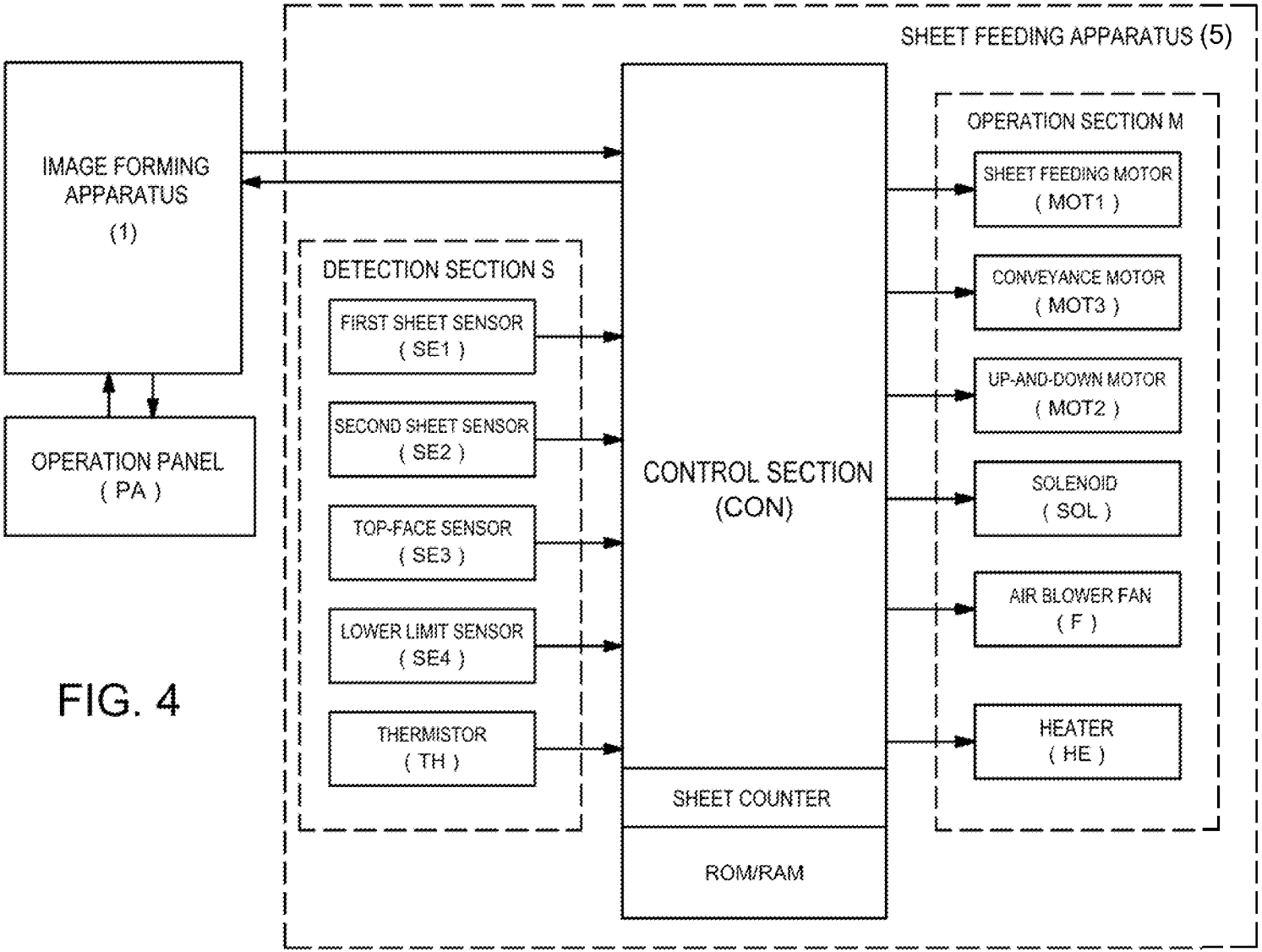
FIG. 4 is a block diagram illustrating a control configuration with emphasis on the sheet feeding apparatus.

FIG. 4 illustrates a control configuration of the sheet feeding apparatus 5 shown in FIG. 2. To a control section CON to control detection and conveyance of the sheet are connected a detection section S comprised of a first sheet sensor SE1, second sheet sensor SE2, top-face sensor SE3, lower limit sensor SE4 and temperature sensor (thermistor) TH, and an operation section M comprised of the sheet feeding motor MOT1, up-and-down motor MOT2, conveyance motor MOT3, solenoid SOL, air blower fans F, and heater HE. Based on a signal detected by the detection section S, the control section CON controls the operation section M to execute various kinds of operations. Further, the control section CON is provided with a sheet counter for counting the number of sheets fed from the stack tray 53, and ROM/RAM to store and read attribution of the sheet to select a first or second sheet handling mode described later, the set number of sheets and the like.

In starting the sheet feeding operation, sheet information is first acquired with reference to attribution of sheets such as paper quality, paper thickness (basis weight) and the like of the sheet. Before starting sheet feeding on a job-by-job basis, these types of sheet information are input via an operation panel PA. Further, when the attribution of sheets is changed, whenever the attribution is changed, new sheet information is input, by operating the operation panel PA.

The separation sheet feeding mechanism 52 is provided with the delivery roller 55 for coming into contact with the top face of the uppermost sheet stacked on the stack tray 53 to sequentially deliver sheets, and a separation mechanism for separating delivered sheets on a sheet-by-sheet basis to convey to the image forming apparatus 2. The separation sheet feeding mechanism 52 is comprised of the sheet feeding roller 56, and the separation roller 57 for coming into press-contact with the sheet feeding roller 56 to prevent second or more sheets from being supplied. On the downstream of the separation sheet feeding mechanism 52 is provided a conveyance roller pair 58 for feeding the sheet into the conveyance path 19 of the image forming apparatus 2.

Further, the separation sheet feeding mechanism 52 is provided with a shift mechanism capable of shifting the delivery roller 55 between a sheet feeding position (contact position) Pa (see FIG. 3A) for bringing the roller 55 into contact with the top face of the sheet, and a retract position Pc (see FIG. 3B) for retracting the roller to a position separated from the top face of the sheet. For example, this shift mechanism is capable of being comprised of a bracket 59 for coupling a rotation shaft 56*a* of the sheet feeding roller 56 and a rotation shaft 55*a* of the delivery roller 55, and a solenoid SOL for holding the bracket 59 swingably. By swinging the bracket 59 in the vertical direction by ON/OFF of the solenoid SOL with the rotation shaft 56*a* of the sheet feeding roller 56 as an axis, it is possible to shift the delivery roller 55 between the sheet feeding position Pa and the retract position Pc. In a state of OFF of the solenoid SOL, as shown in FIG. 3A, the roller is biased to come into contact with the top face of the uppermost sheet P stacked on the stack tray 53, and when the solenoid SOL is turned ON, as shown in FIG. 3B, retracts from the top face of the sheet P.

The delivery roller 55 is driven to rotate by the sheet feeding motor MOT1, and delivers the uppermost sheet P from the stack tray 53. Similarly, by the sheet feeding motor MOT1, the sheet feeding roller 56 is driven to rotate via a plurality of gears and timing belt not shown in the figure, and feeds the sheet delivered from the stack tray 53 by the delivery roller 55 in the sheet feeding direction. The conveyance roller pair 58 is driven to rotate by the conveyance motor MOT3, and supplies the sheet fed out from the sheet feeding roller 56 to the image forming apparatus 2.

In the separation roller 57, a torque limiter (now shown) is attached to its rotation shaft. By this means, when two or more sheets overlap and are nipped in a press-contact portion of the sheet feeding roller 56 and the separation roller 57, the separation roller 57 halts to prevent second or more sheets from being supplied. For example, when a plurality of sheets overlaps and enters the press-contact portion of the sheet feeding roller 56 and the separation roller 57, since a drive force of the sheet feeding roller 56 is transferred to the uppermost sheet, while rotation of the separation roller 57 is halted, a slip occurs between the uppermost sheet and the sheet below the uppermost sheet, and only the uppermost sheet is separated from the sheet below the uppermost sheet, and is fed out. In addition, as a substitute for the separation roller 57, it may be possible to use other members such as a separation pad.

In order to detect positions of the stack tray 53 and the sheet in an up-and-down direction, the sheet feeding apparatus 5 is provided with the lower limit sensor SE4 and top-face sensor SE3. As shown in FIG. 2, the lower limit sensor SE4 is disposed in a lower limit position Pb in an up-and-down range of the stack tray 53. The top-face sensor SE3 detects that the uppermost sheet on the stack tray 53 arrives at a height position i.e. sheet feeding position Pa for enabling the separation sheet feeding mechanism 52 to feed the sheet toward the image forming apparatus 2.

Further, the sheet feeding apparatus 5 has the first sheet sensor SE1 disposed in the vicinity of a sheet exist of the sheet feeding roller 56 i.e. immediately on the downstream side in the sheet feeding direction. As described later, the first sheet sensor SE1 detects a rear end of the sheet fed from the sheet feeding roller 56 to the conveyance roller pair 58.

At the time of start-up by power supply ON, or when the sheet feeding apparatus 5 detects that the storage chamber 51, which is pulled out from the housing 50, is stored inside the housing by a detection sensor (not shown), the apparatus drives the up-and-down motor MOT2 to move the stack tray 53 up. When the apparatus detects that the top face of the uppermost sheet on the stack tray 53 arrives at the sheet feeding position Pa by the top-face sensor SE3, the apparatus controls the up-and-down motor MOT2 to halt ascent of the stack tray 53.

Further, the delivery roller 55 is shifted to the sheet feeding position Pa to make a state for enabling the uppermost sheet on the stack tray 53 to be picked up. Furthermore, whenever the predetermined number of sheets is picked up from the stack tray 53 by the delivery roller 55, the sheet feeding apparatus 5 raises the stack tray 53 to control so that the top face of the uppermost sheet is present in the sheet feeding position Pa.

For example, in the case where a variation of a coefficient of friction occurs between upper and lower sheets on the stack tray 53 by an effect of temperature, humidity or the like inside the sheet feeding apparatus 5, upper and lower sheets are brought into intimate contact with each other by a cut burr left on sheet side edges, or the like, even when the separation sheet feeding mechanism 52 is used, multi-feed may occur where the next sheet overlaps the uppermost sheet and is fed. In order to prevent such multi-feed from occurring, the blower unit 80 is provided to blow air to side faces of sheets stacked on the stack tray 53.

As shown in FIG. 2, the air blower unit 80 is comprised of the first air blower section 62 on the image forming apparatus 2 side and the second air blower section 63 on the upstream side of the section 62. Each section has the air blower fan F, and the first air blower section 62 is provided with the heater HE on the upstream side of the air blower fan F.

The air blower fan F enables a rotation speed to be switched, and is capable of varying a wind speed to blow. The heater HE is capable of being set at an arbitrary temperature, and by this means, the first air blower section 62 is capable of blowing air heated at a desired temperature. For example, in the case where humidity is high in an atmosphere where the sheet feeding apparatus 5 is set, dried air is blown.

As shown in FIGS. 3A and 3B, the blowoff openings 65*a*, 65*b* respectively provided in the first and second air blower sections 62, 63 are formed in dimension and form such that its upper end is positioned higher to some extent than the uppermost sheet P of a sheet bunch stacked on the stack tray 53, and that its lower end contains a plurality of sheets below the uppermost sheet P. The blowoff openings 65*a*, 65*b* are disposed at a predetermined interval in the sheet feeding direction so that the blowoff opening 65*a* blows air to a front end side (side face on the downstream side) in the sheet feeding direction of the sheet on the stack tray 53, and that the blowoff opening blows air to a rear end side (side face on the upstream side) opposite to the sheet feeding direction of the sheet on the stack tray 53.

Based on the sheet information recognized by the control section CON described later, the air blower unit 80 drives the air blower fans F, and blows air at a predetermined wind speed from the blowoff openings 65*a*, 65*b*. For example, the sheet information includes the size, basis weight, type, surface state (surface roughness, etc.), feeding direction and the like of the sheet. Further, in response to installation environments (temperature, humidity, etc.) of the sheet feeding apparatus the air blower unit 80 is capable of appropriately setting and adjusting the wind speed (rotation speed of the air blower fan F) of air and/or ON/OFF and heating temperature of the heater HE. Furthermore, as required, the unit 80 is capable of driving a blowoff direction varying mechanism (not shown) to vary the air blowoff directions from the blowoff openings 65*a*, 65*b* in the vertical direction or to swing up and down.

As described above, when the sheet feeding apparatus 5 is started, or the pulled-out storage chamber 51 is returned into the housing 50, by the up-and-down motor MOT2, the stack tray 53 moves up to a position in which the top face of the uppermost sheet arrives at the sheet feeding position Pa. In this Embodiment, at this point, the air blower fan F is driven, and as necessary, the heater HE is heated. Then, air is blown to side faces of upper sheets from the blowoff openings 65*b*. Thus, by simultaneously blowing air on the front end side and rear end side of the upper sheets, it is possible to handle the upper sheets on the stack tray 53 to effectively resolve the intimate contact state of the sheets.

In a state in which the delivery roller 53 is brought into contact with the top face of the uppermost sheet P of the stack tray 53, when the top-face sensor SE3 detects the sheet, the sheet feeding motor MOT1 is driven to rotate forward. By this means, the uppermost sheet is fed out in the sheet feeding direction. Thus fed-out sheet is conveyed in the state in which the sheet is separated on a sheet-by-sheet basis by the separation conveyance mechanism comprised of the sheet feeding roller 56 and the separation roller 57.

As shown in FIGS. 2, 3A and 3B, the sheet feeding apparatus 5 of the present invention is configured to perform stable sheet feeding control, while efficiently handling sheets stacked on the stack tray 53, by the shift mechanism (solenoid SOL) for swinging the delivery roller 55, and the air blower mechanism by blowing air from the blowoff openings 65*a*, 65*b* provided in the air blower unit 80. As a mechanism for performing such sheet feeding control, the apparatus has a first sheet handling mode (first operation) and second sheet handling mode (second operation) by combinations of the shift mechanism and air blower mechanism. The first sheet handling mode is a mode for blowing air to the sheet stacked on the stack tray 53 by the air blower unit 80 in a state in which the delivery roller 55 shifts to the sheet feeding position Pa by the shift mechanism. The second sheet handling mode is a mode for blowing air to the sheet stacked on the stack tray 53 by the air blower unit 80 in a state in which the delivery roller 55 shifts to the retract position Pc by the shift mechanism. The control section CON selects the first sheet handling mode or the second sheet handling mode, and before rotating the delivery roller 55 forward to deliver the sheet, switches to one of the modes. Further, for continuously fed sheets, switching of the mode is performed for a period during which delivery operation of a prior sheet by the delivery roller 55 is finished, and then, delivery operation of a succeeding sheet is started.

Figure 5A:
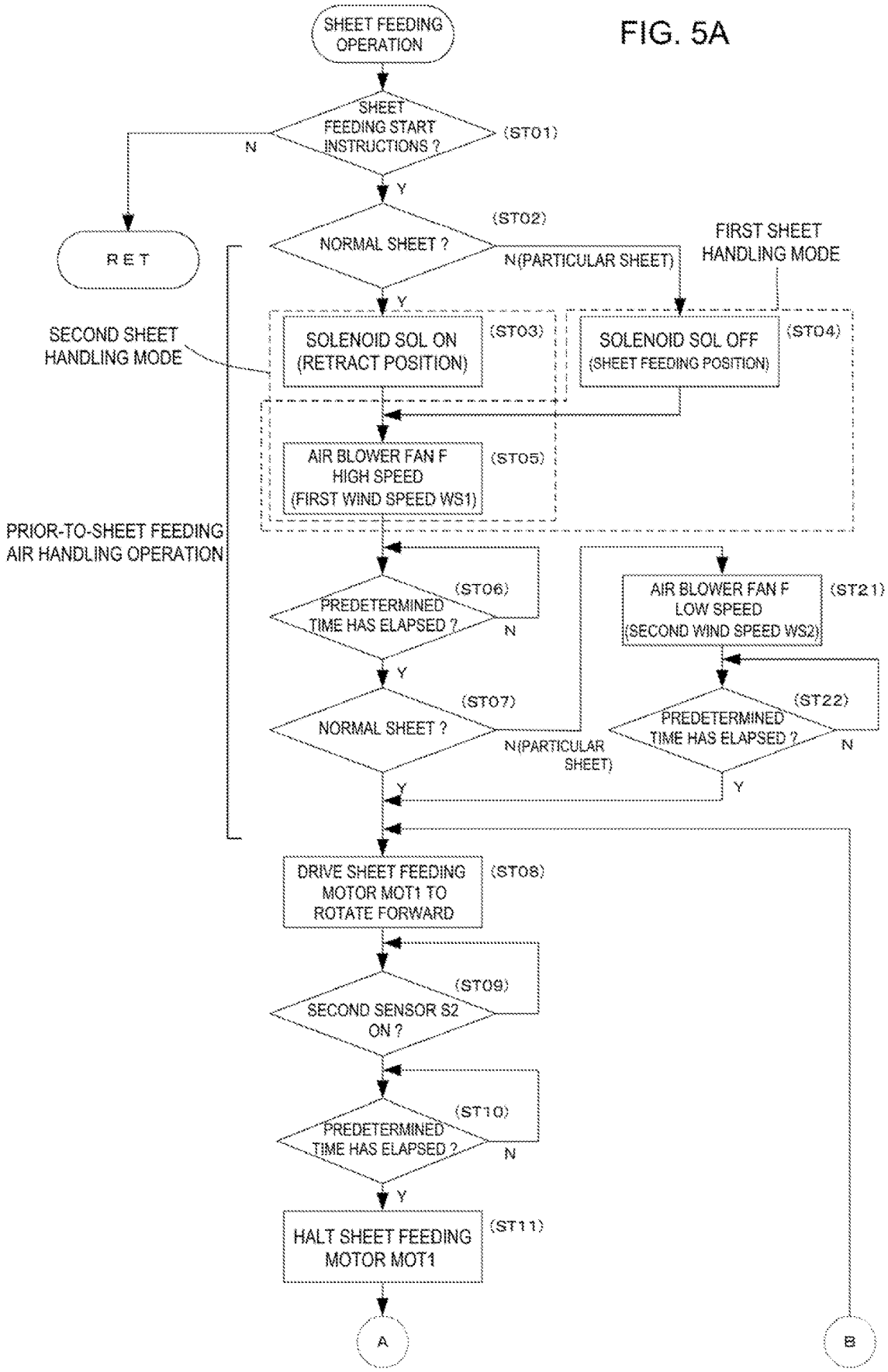
FIG. 5A is a flowchart illustrating sheet feeding and sheet handling operation in the sheet feeding apparatus.
Figure 5B:
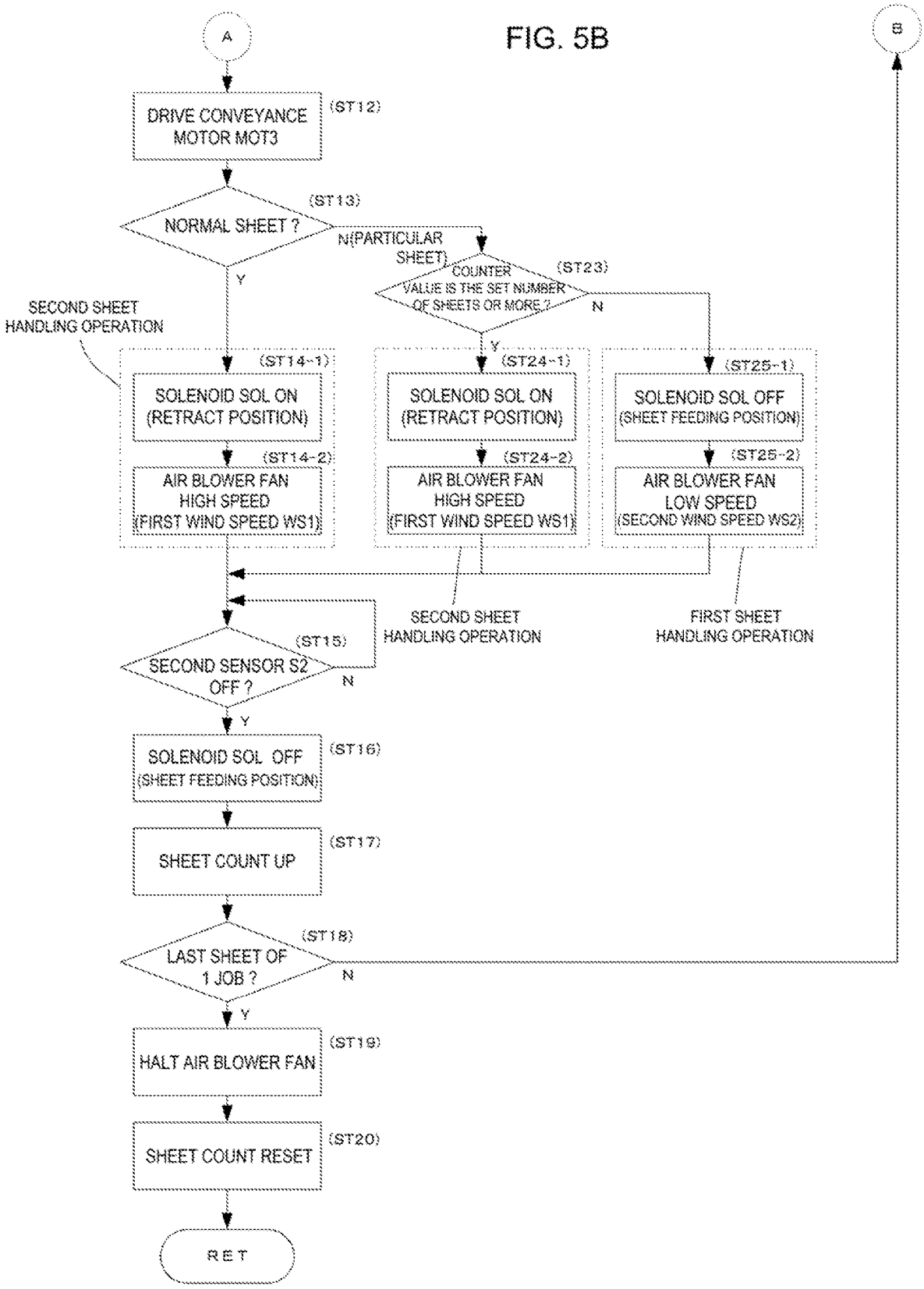
FIG. 5B is another flowchart illustrating sheet feeding and sheet handling operation in the sheet feeding apparatus.

Hereinafter, using flowcharts shown in FIGS. 5A and 5B, descriptions will be given to sheet feeding and sheet handling operation of the sheet feeding apparatus 5. Sheets to use are classified into normal sheets and particular sheets. Herein, it is assumed that the particular sheets are coat paper which is thinner than plain paper and is weak in stiffness and the like. Further, the normal sheets are sheets except the particular sheet, and for example, are sheets generally used as copy paper, and the like.

First, upon receiving (ST01) sheet feeding instructions from the image forming apparatus 2 via the operation panel PA, the control section CON executes the so-called prior-to-sheet feeding air handling operation for blowing air to sheets to handle during a certain time before feeding sheets. In the prior-to-sheet feeding air handling operation, when sheets on the stack tray 53 are the particular sheet, the solenoid SOL is turned OFF, the delivery roller is shifted to the sheet feeding position, and the air blower fan F provided in the air blower unit 80 is rotated at a high speed (60 rps) to be a first wind speed WS1 (ST02, ST04, ST05). In other words, herein, the above-mentioned first sheet handling mode is executed. On the other hand, when the sheet is the normal sheet, the solenoid SOL is turned ON, the delivery roller is shifted to the retract position, and the air blower fan F is rotated at the high speed (60 rps) to be the first wind speed WS1 (ST02, ST03, ST05). In other words, herein, the above-mentioned second sheet handling mode is executed.

In the prior handling operation, the air blower fan F provided in the air blower unit 80 is rotated at the high speed (60 rps), and blows air toward side faces of a plurality of upper sheets of a sheet bundle stacked on the stack tray 53 at the first wind speed WS1. At this point, the control section CON determines whether the sheets stacked on the stack tray 53 are the normal sheet or the particular sheet, from the information of attribution (paper quality, paper thickness (basis weight)) of the sheet from the operation panel PA. Then, when the sheet is the particular sheet, the control section CON turns the solenoid SOL of the shift mechanism OFF to shift the delivery roller 55 to the sheet feeding position Pa, and executes the first sheet handling mode (first operation) (see timing charts of FIGS. 6A to 6C). On the other hand, when the sheet is the normal sheet, the control section CON turns the solenoid SOL of the shift mechanism ON to shift the delivery roller 55 to the retract position Pc, and executes the second sheet handling mode (second operation) (see timing charts of FIGS. 7A to 7C).

Subsequently, in the case where a predetermined time has elapsed since the rotation start of the air blower fan F (ST06), and sheets to feed are the normal sheet, in a state in which the first wind speed WS1 is maintained, the sheet feeding motor MOT1 is driven to rotate forward, and sheet feeding is started (ST07-ST08).

On the other hand, in step (ST07), in the case where sheets to feed are the particular sheet, the control section CON switches the rotation speed of the air blower fan F from the high speed (60 rps) to a low speed (40 rps) (ST21). By this means, for the wind speed of air blown toward side faces of a plurality of upper sheets of the sheet bundle stacked on the stack tray 53, the wind speed is varied from the first wind speed WS1 to a second wind speed WS2 lower than the first wind speed WS1. Then, after a lapse of predetermined time (ST22), the sheet feeding motor MOT1 is driven to rotate forward, and sheet feeding is started (ST08). In addition, the predetermined time in the step (ST22) is set based on the time required for the wind speed to reach the low speed (40 rps) immediately after starting reduction of the number of revolutions of the air blower fan F.

Then, rotation-forward drive of the sheet feeding motor MOT1 is halted, after the second sheet sensor SE2 detects a sheet which is delivered by the delivery roller 55 and fed by the sheet feeding roller 56, and further, a predetermined time has elapsed (ST09-ST11). By this means, a front end of the sheet strikes the press-contact portion between the conveyance roller pair 58, and is registered in a looped state.

After the sheet feeding motor MOT1 is halted in step STO8 in the figure, by driving the conveyance motor MOT3, the first sheet is conveyed to the downstream side (ST12).

Next, when the succeeding sheet is the normal sheet, the second sheet handling operation is executed. In other words, the solenoid SOL is turned ON to shift the delivery roller 55 to the retract position Pc retracted from the sheet, and the air blower fan F is continuously rotated at the high speed (60 rps) to blow air to sheets stacked on the stack tray 53 at the first wind speed WS1 (ST13, ST14-1, ST14-2).

On the other hand, in step ST13 in the figure, when the sheet to feed is the particular sheet, it is determined whether or not the number of sheets delivered by the delivery roller 55 is the beforehand set number of sheets or more (ST23). At this point, based on the set number of sheets delivered by the delivery roller 55, the control section CON selects one from the first sheet handling mode and the second sheet handling mode. In the case where the number of sheets delivered by the delivery roller 55 is lower than the set number of sheets, the first sheet handling mode is selected. When the number is the set number or more, the second sheet handling mode is selected.

In the first sheet handling mode, in the state in which the solenoid SOL is turned OFF and the delivery roller 55 is brought into contact with the top face of the sheet, the air blower fan F is continuously rotated at the low speed (40 rps), and blows air to sheets stacked on the stack tray 53 at the second wind speed WS2 (ST25-1, ST25-2). In the second sheet handling mode, the solenoid SOL is turned ON to shift the delivery roller 55 to the retract position Pc retracted from the sheet, and the air blower fan F is switched to the high speed (60 rps) to rotate, and blows air to sheets stacked on the stack tray 53 at the first wind speed WS1 (ST24-1, ST24-2).

When the sheet undergoing sheet feeding is fed to the downstream side by the conveyance roller pair 58, the second sheet sensor SE2 is OFF, and the rear end of the sheet is detected, the solenoid SOL is switched to OFF (ST15-ST16). By this means, the delivery roller 55 is shifted to the sheet feeding position, and the sheet on the stack tray 53 becomes a sheet-feeding-capable state. Then, a count value of sheets is incremented (ST17), and it is determined whether or not the sheet is the last sheet of 1 job (ST18). Herein, when the sheet is not the last sheet of 1 job, the process returns to step ST08 in the figure, and sheet feeding operation is continued up to the last sheet of 1 job. When it is determined that the sheet is the last sheet of 1 job, the air blower fan F is halted (ST16), the sheet counter value is reset (ST17), and the sheet feeding operation is finished.

Figures 6A, 6B, 6C:
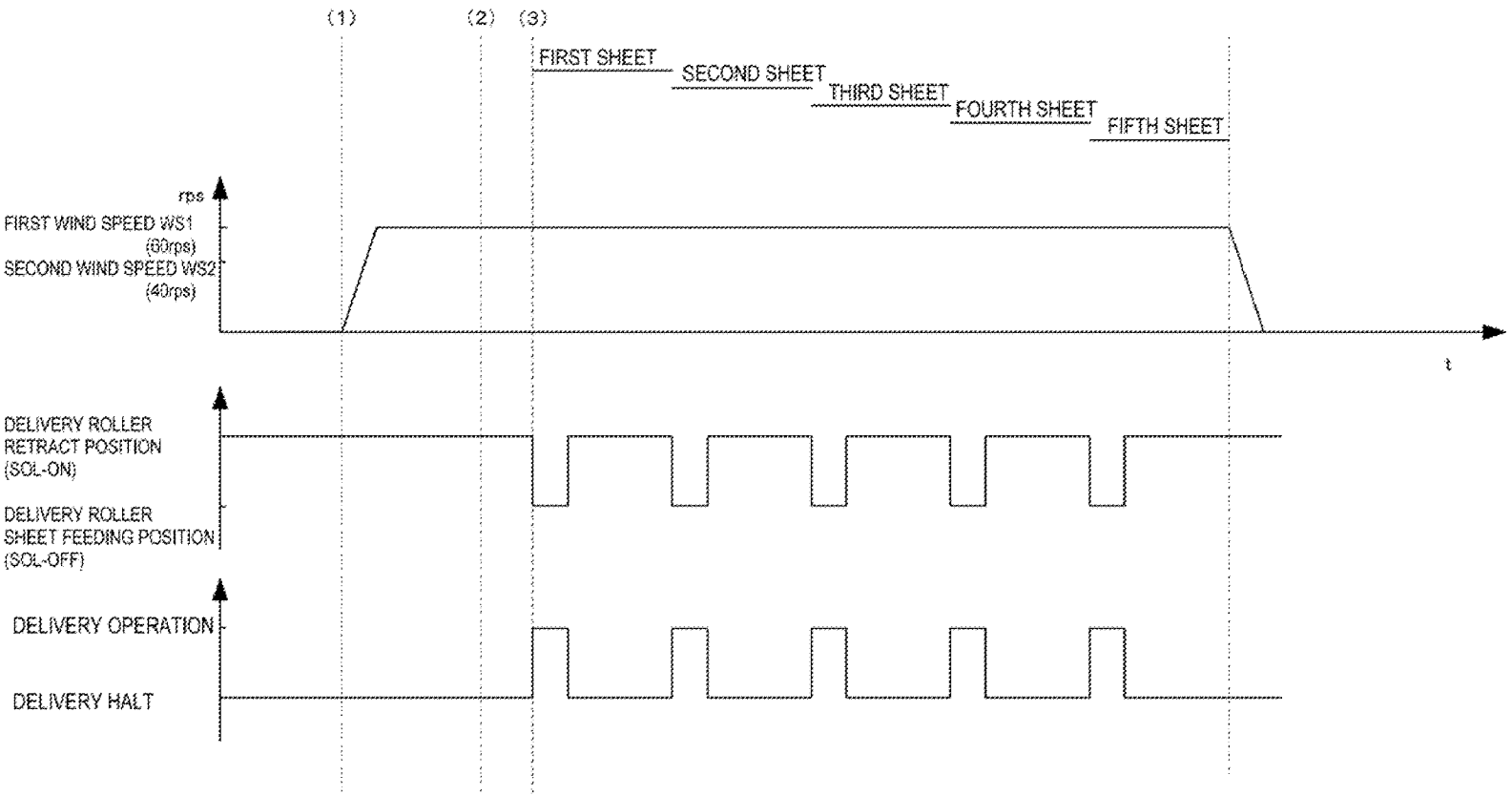
FIGS. 6A to 6C are timing charts illustrating sheet feeding and sheet handling operation suitable for normal sheets.
Figures 7A, 7B, 7C:
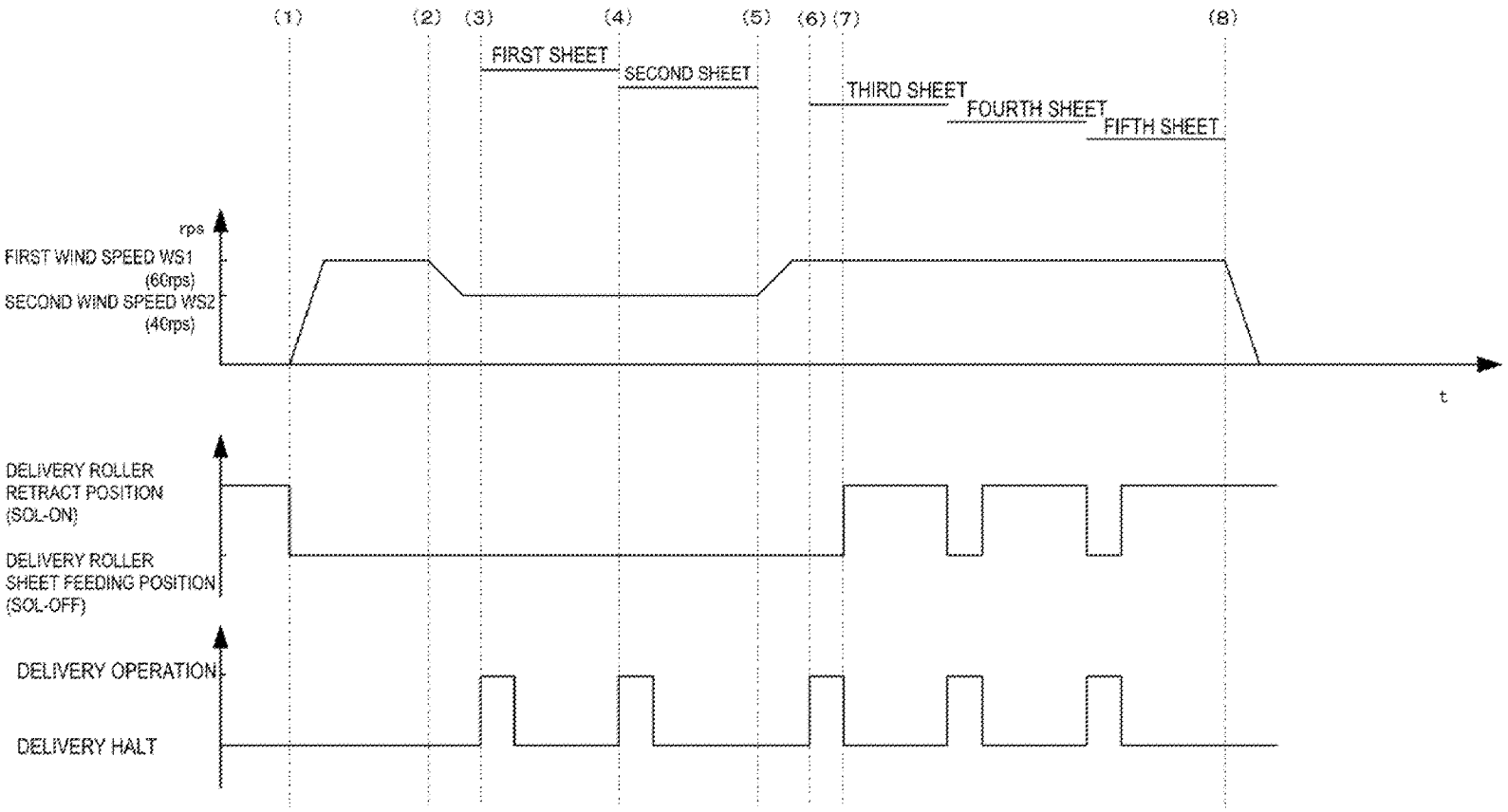
FIGS. 7A to 7C are timing charts illustrating sheet feeding and sheet handling operation suitable for particular sheets.

FIGS. 6A to 6C and FIGS. 7A to 7C are timing charts illustrating drive states of the air blower fan F, solenoid SOL and sheet feeding motor MOT1, in executing the aforementioned sheet feeding and handling operation of sheets by air of the sheet feeding apparatus 5. Based on the timing charts of FIGS. 6A to 6C and FIGS. 7A to 7C, the sheet feeding operation will be described for each of the normal sheet and particular sheet. FIGS. 6A to 6C illustrate the sheet feeding operation for the normal sheet where the second sheet handling mode (second operation) is executed, and FIGS. 7A to 7C illustrate the sheet feeding operation for the particular sheet where the first sheet handling mode (first operation) is executed. In FIGS. 6A to 6C and FIGS. 7A to 7C, the horizontal axis t represents a time axis, and the vertical axis represents the number of revolutions (rps) of the air blower fan F in FIGS. 6A and 7A, represents ON/OFF of the solenoid SOL in FIGS. 6B and 7B, and represents a state of drive/halt of the delivery roller 55 by drive of the sheet feeding motor MOT1 in FIGS. 6C and 7C. In addition, herein, it is assumed that the number of sheets is "5" for a series of sheet feeding unit (1 job).

First, based on the timing charts of FIGS. 6A to 6C, the sheet feeding operation will be described in the case of the normal sheet.

(1) When the sheet feeding apparatus 5 receives instructions for sheet feeding, the air blower fan F rotates at the high speed (60 rps), and blows air to sheets at the first wind speed WS1. At this point, the delivery roller 55 is kept at the retract position.

(2) Subsequently, by blowing to the sheets at the first wind speed WS1 until the predetermined time has elapsed, the sheet handling operation prior to sheet feeding is performed on the normal sheet.

(3) Then, the sheet feeding operation is started for 1 job. The wind speed is maintained at the state of the first wind speed WS1, and the delivery roller 55 is in the sheet feeding position Pa during sheet feeding, and when sheet feeding is halted, shifts to the retract position. This process is executed repeatedly up to the 5th sheet that is the last sheet of 1 job.

Thus, in the case of the normal sheet, since basis weight is high, even when the delivery roller 55 is in the retract position Pc, by blowing to sheets constantly at the first wind speed WS1 that is the high speed, it is possible to efficiently perform sheet handling.

Next, based on the timing charts of FIGS. 7A to 7C, the sheet feeding operation will be described in the case of the particular sheet. In the case of the particular sheet, the control section CON executes sheet feeding by the first sheet handling mode up to the first set number of sheets of 1 job, and for subsequent sheets exceeding the set number of sheets, executes sheet feeding by the second sheet handling mode. In this Embodiment, the total number of sheets of 1 job is set at "5", and the set number of sheets is set at "2".

(1) When the sheet feeding apparatus 5 receives instructions for sheet feeding, the air blower fan F rotates at the high speed (60 rps) to blow air at the first wind speed WS1. Concurrently therewith, the delivery roller 55 shifts from the retract position (see FIG. 3B) to the sheet feeding position Pa (see FIG. 3A).

(2) After a lapse of predetermined time, rotation of the air blower fan F is switched from the high speed (60 rps) to the low speed (40 rps). By this means, air blown to sheets is switched from the first wind speed WS1 to the second wind speed WS2, and sheet handling on the particular sheet is performed at the second wind speed WS2.

(3) After reaching the second wind speed WS2, sheet feeding is started by the first sheet handling mode.

(4) When the second sheet sensor SE2 detects the rear end of the first sheet, sheet feeding of the second sheet is started.

(5) When the second sheet sensor SE2 detects the rear end of the second sheet, the control section CON switches the first sheet handling mode to the second sheet handling mode. In the second sheet handling mode, after shifting the delivery roller 55 to the retract position, rotation of the air blower fan F is switched from the low speed (40 rps) to the high speed (60 rps). By this means, air blown to the sheet is switched from the second wind speed WS2 to the first wind speed WS1, and handling of sheets on third or more particular sheets is performed at the first wind speed WS1.

(6) After the wind speed of air blown to the sheet reaching the first wind speed WS1, feeding of the third sheet is started.

(7) When the second sheet sensor SE2 detects the rear end of the third sheet, and register operation is finished, the sheet feeding operation is finished, and the delivery roller 55 shifts to the retract position.

(8) Subsequently, fourth and fifth sheets are fed. Then, when the rear end of the last (fifth) sheet is detected by the first sheet sensor SE1, the sheet feeding operation of 1 job is finished, and the air blower fan F is halted.

Thus, for the particular sheet low in stiffness with predetermined basis weight or less, until the first set number of sheets, since air is blown to the sheet at the second wind speed WS2 that is the low speed in the state in which the delivery roller 55 shifts to the sheet feeding position Pa, the sheet does not undergo misregistration, and it is possible to perform sheet feeding operation with importance placed on stability. On the other hand, when the number of fed sheets is the set number of sheets or more, since sheet feeding is stabilized, air is blown to the sheet at the first wind speed WS1 that is the high speed, while switching the delivery roller 55 between the sheet feeding position Pa and the retract position Pc, and it is thereby possible to perform sheet feeding operation with importance placed on efficiency of sheet handling.

Table 1 shows recommendation patterns of sheet feeding operation in the sheet feeding apparatus of the present invention for each attribution (paper quality, basis weight) of sheets. In a pattern A, except the time sheet feeding is performed, the delivery roller is shifted to the retract position, and air is blown (see FIGS. 6A to 6C). In a pattern B, until the first set number of sheets of 1 job, with the delivery roller fixed to the sheet feeding position, sheets are fed, while blowing air, and in the stage in which the number of fed sheets exceeds the set number of sheets, the pattern shifts to the pattern A (see FIGS. 7A to 7B).

In the case of the normal sheet (plain paper), the pattern A is suitable, irrespective of basis weight of the sheet. On the other hand, in the case of the particular sheet (coat paper), when the basis weight is 106 g or more, the pattern A that is the same as the plain paper is suitable, and when the basis weight is 105 g or less, the pattern B is suitable.

TABLE 1

| Basis weight (g) | Plain paper | Coat paper |
|---|---|---|
| 52~105 | A | B |
| 106~150 | A | A |
| 151~ | A | A |

In the above-mentioned Embodiment, as one example, it is described that the first sheet handling mode is executed in the case of the particular sheet determined from the basis weight and paper quality of the sheet, and that the second handling mode is executed in the case of the normal sheet except the particular sheet, but the present invention is not limited thereto. It is also possible to select and execute one of the first sheet handling mode and the second sheet handling mode, based on one of the size of the sheet, basis weight of the sheet, paper quality of the sheet, and temperature, humidity or the like inside the sheet feeding apparatus 5. For example, it is possible to execute the first handling mode for sheets of a predetermined size or less, while executing the second handling mode for sheets larger than the predetermined size. Alternatively, it is possible to execute the first handling mode for sheets of predetermined basis weight or less, while executing the second handling mode for sheets larger than the predetermined basis weight.

In other words, the present invention is described with reference to the preferred Embodiment, but it is obvious that the invention is not limited to the above-mentioned Embodiment, and is capable of being carried into practice with various changes or modifications thereof within the technical scope of the invention.

This application claims priority from Japanese Patent Application No. 2022-071645 filed on Apr. 25, 2022, and all of described contents described in the Japanese Patent Application are incorporated herein by reference.

The invention claimed is:

1. A sheet feeding apparatus for feeding sheets, comprising:

a stack tray adapted to stack sheets;

a delivery roller adapted to deliver the sheets stacked on the stack tray;

a shift mechanism adapted to shift the delivery roller between a contact position to come into contact with a top face of an uppermost sheet stacked on the stack tray, and a retract position to retract from the top face of the sheet;

an air blower mechanism adapted to blow air to side portions in a width direction of the sheets stacked on the stack tray; and a control section adapted to control the shift mechanism and the air blower mechanism, wherein the control section selects one of first operation for blowing the air to the sheets stacked on the stack tray in a state in which the delivery roller is in the contact position, before the delivery roller delivers the sheets, and second operation for blowing the air to the sheets stacked on the stack tray in a state in which the delivery roller is in the retract position, to execute.

2. The sheet feeding apparatus according to claim 1, wherein corresponding to basis weight of the sheets stacked on the stack tray, the control section selects one of the first operation and the second operation to execute.

3. The sheet feeding apparatus according to claim 1, wherein corresponding to paper quality of the sheets stacked on the stack tray, the control section selects one of the first operation and the second operation to execute.

4. The sheet feeding apparatus according to claim 1, wherein corresponding to a size of the sheets stacked on the stack tray, the control section selects one of the first operation and the second operation to execute.

5. The sheet feeding apparatus according to claim 1, wherein the control section executes the first operation for particular sheets stacked on the stack tray, and executes the second operation for sheets except the particular sheets.

6. A sheet feeding apparatus for feeding sheets, comprising:

a stack tray adapted to stack sheets;

a delivery roller adapted to deliver the sheets stacked on the stack tray;

an air blower mechanism adapted to blow air to end portions in a width direction of the sheets stacked on the stack tray, before the delivery roller delivers the sheets; and a shift mechanism adapted to shift the delivery roller to a contact position to come into contact with a top face of an uppermost sheet stacked on the stack tray, and to a retract position to retract from the top face of the sheet, wherein when the air blower mechanism blows the air to the sheets, corresponding to basis weight of the sheets on the stack tray, the shift mechanism shifts or maintains the delivery roller to/at one of the contact position and the retract position.

7. The sheet feeding apparatus according to claim 6, wherein when the basis weight of the sheets on the stack tray is predetermined basis weight or less, the shift mechanism shifts or maintains the delivery roller to/at the contact position, and when the basis weight of the sheets on the stack tray is larger than the predetermined basis weight, shifts or maintains the delivery roller to/at the retract position.

8. The sheet feeding apparatus according to claim 6, wherein when the sheets on the stack tray are coat paper with predetermined basis weight or less, the shift mechanism shifts or maintains the delivery roller to/at the contact position, and when the sheets on the stack tray are sheets except the coat paper with the predetermined basis weight or less, shifts or maintains the delivery roller to/at the retract position.

9. A sheet feeding apparatus for feeding sheets, comprising:

a stack tray adapted to stack sheets;

a delivery roller adapted to sequentially deliver the sheets stacked on the stack tray;

a shift mechanism adapted to shift the delivery roller to a contact position to come into contact with an uppermost sheet, and to a retract position to retract from the uppermost sheet;

an air blower mechanism adapted to blow air to end portions in a width direction of the sheets stacked on the stack tray; and a control section adapted to execute first operation for blowing the air to the sheets stacked on the stack tray by the air blower mechanism in a state in which the delivery roller shifts to the contact position by the shift mechanism, and second operation for blowing the air to the sheets stacked on the stack tray by the air blower mechanism in a state in which the delivery roller shifts to the retract position by the shift mechanism, wherein for a period during which delivery operation of a sheet by the delivery roller is finished, and then, delivery operation of a next sheet is started, the control section selects one of the first operation and the second operation to execute.

10. The sheet feeding apparatus according to claim 9, wherein based on the set number of sheets delivered by the delivery roller, the control section selects one of the first operation and the second operation.

11. The sheet feeding apparatus according to claim 10, wherein up to the set number of sheets delivered by the delivery roller, the control section selects the first operation, and selects the second operation for sheets exceeding the set number of sheets.

12. The sheet feeding apparatus according to claim 10, wherein the air blower mechanism is provided with an air blower fan for switching a rotation speed from a low speed to a high speed, when sheets delivered by the delivery roller exceed the predetermined number of sheets.

13. The sheet feeding apparatus according to claim 9, wherein corresponding to attribution of the sheets stacked on the stack tray, the control section selects one of the first operation and the second operation.

14. The sheet feeding apparatus according to claim 13, wherein the attribution of sheets is defined using paper quality and basis weight.

* * * * *